US005266969A

United States Patent [19]

Mochizuki

[11] Patent Number: 5,266,969

[45] Date of Patent: Nov. 30, 1993

[54] THERMAL TRANSFER COLOR PRINTER

[75] Inventor: Tatsuo Mochizuki, Yamanashi, Japan

[73] Assignee: Nisca Corporation, Japan

[21] Appl. No.: 845,707

[22] Filed: Mar. 4, 1992

[30] Foreign Application Priority Data

| | | | |
|---|---|---|---|
| Mar. 28, 1991 | [JP] | Japan | 3-89681 |
| Mar. 28, 1991 | [JP] | Japan | 3-89682 |
| Mar. 28, 1991 | [JP] | Japan | 3-89683 |
| Apr. 27, 1991 | [JP] | Japan | 3-124796 |
| Apr. 27, 1991 | [JP] | Japan | 3-124797 |
| Jul. 25, 1991 | [JP] | Japan | 3-210059 |

[51] Int. Cl.[5] ..... B41J 2/325

[52] U.S. Cl. ..... 346/76 PH; 346/134; 400/120

[58] Field of Search ..... 346/76 PH, 134; 400/120, 624, 629, 630, 634, 636

[56] References Cited

U.S. PATENT DOCUMENTS 4,738,555 4/1988 Nagashima ..... 346/76 PH

FOREIGN PATENT DOCUMENTS

| | | |
|---|---|---|
| 59-95194 | 6/1984 | Japan . |
| 59-198196 | 11/1984 | Japan . |
| 61-51391 | 3/1986 | Japan . |
| 61-83094 | 4/1986 | Japan . |
| 2-63892 | 3/1990 | Japan . |
| 3-67665 | 3/1991 | Japan . |

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

In a thermal transfer color printer, three principal portions composed of a sheet feed portion for sending out printing sheets one by one, a printing portion for printing the sheet with thermal transfer color inks, and a sheet discharge portion having a sheet discharge tray for receiving the printed sheet are arranged in a Y-shape around a branch portion. Thus, the passage for feeding the printing sheet and the overall size of the printer are reduced, whereby multicolored prints of good quality can be obtained without misregistration of coloring.

21 Claims, 5 Drawing Sheets

THERMAL TRANSFER COLOR PRINTER

BACKGROUND OF THE INVENTION

1. Field of the Invention

This invention relates to a thermal transfer color printer capable of producing multicolored prints by using a thermal transfer printing ink ribbon, and more particularly to a full-color printer in which a sheet feed portion, printing portion and sheet discharge portion are arranged in the shape of a Y to increase the printing efficiency and performance and reduce the overall size.

2. Description of the Prior Art

There have been developed a variety of color printers such as an ink-jet printer and laser printer for obtaining a polychromic hard copy printed with an image corresponding to a colored visual impression produced on a computer display or the like. Of the color printers, a thermal transfer color printer has recently held a dominant position since it is excellent in size, handling, maintenance and picture quality such as color developing property and reproducibility. Typical thermal transfer color printers generally uses a thermal transfer ink ribbon coated with thermal transfer inks such as hot-melt color inks or sublimation-type color inks which are fundamentally composed of three primary colors of yellow, magenta and cyan. Occasionally, there is a case that black is added to the primary colors. The ink ribbon comes into close contact with a printing sheet such as paper so as to thermally transfer the color inks onto the printing sheet in turn by driving a thermal head having heating elements. That is, by carrying out the thermal transfer process for each of the primary colors, a desired image of full colors can be reproduced on the printing sheet.

For the purpose of heightening the ink transferring property and the coloring quality, an ink receiptor layer such as a binding or coating material for surface treatment is previously applied onto the printing sheet prior to printing, so as to make the surface of the printing sheet smooth and improve fixing of the inks on the printing sheet. The use of the binding material for that purpose is found in Japanese Patent Application Public Disclosures Nos. SHO 59-198196(A), SHO 61-83094(A), HEI 2-63892(A), and HEI 3-67665(A), and U.S. Pat. No. 4,660,051.

Further, U.S. Pat. No. 4,738,555 (corresp. to Japanese Pat. Appln. Pub. Discl. No. SHO 61-51391(A)) and U.S. Pat. No. 5,527,171 (corresp to Japanese Pat. Appln. Pub. Discl. No. SHO 59-95194(A)) disclose an after-treatment method for coating the surface of a printed sheet (hard copy) with a transparent protector layer to intimately fix the color inks on the sheet and prevent discoloration of the inks printed on the sheet.

Incidentally, it is technically impossible to apply the aforementioned ink receiptor layer and protector layer together on one ink ribbon. Thus, in order to provide the thermal transfer printer with both functions of effecting pretreatment for coating the sheet before printing with the ink receiptor layer and after-treatment for coating the printed sheet after printing with the ink protector layer, means for applying the ink receiptor layer and means for applying the ink protector layer should be prepared individually. However, since means for transferring the thermal transfer inks of three primary colors onto the printing sheet can be combined with either the pretreatment means or the after-treatment means, only two means suffice for the processes of effecting the pretreatment, printing and after-treatment.

In the thermal transfer printer using the three or more primary color inks, the color inks must be applied precisely to the identical portion on the surface of the printing sheet. Since the thermal transfer printer of this type causes the printing sheet being in contact with the ink ribbon to be moved relative to the thermal head, the printing sheet is required to be moved backward and forward at least three times relative to the thermal head. In the case of previously coating the printing sheet with the ink receiptor layer in the ink transferring portion of the printer, the backward and forward movements of the printing sheet should be carried out at least four times. However, the printing quality depends upon the registering of printing, and therefore, the relative positions between the printing sheet and the thermal head should be adjusted with a high degree of preciseness to ensure that the printed color dots on the printing sheet are in register.

Also in the conventional thermal transfer printer, the sheet feed portion from which the printing sheet is fed out, the printing portion on which the color inks are applied onto the printing sheet and sheet discharge portion to which the printed sheet is sent out are generally arranged in a line so as to move the printing sheet in one direction from the sheet feed portion to the sheet discharge portion through the printing portion. Accordingly, the printer necessitates the length equal to the total lengths of the sheet feed portion, printing portion and sheet discharge portion, and thus, it turns out to be large in size. Furthermore, since the protector layer applying means as noted above must be in actually added to the color printer of this type, the overall size, of the printer is inevitably increased, resulting in a greater possibility of failure of color registration (misregistration), and the resultant printing speed slows down.

OBJECT OF THE INVENTION

This invention is made to eliminate the drawbacks suffered by the conventional thermal transfer full-color printer as described above and has an object to provide a thermal transfer color printer capable of producing multicolored prints by using a thermal transfer printing ink ribbon with good quality without misregistration of coloring.

Another object of this invention is to provide a thermal transfer color printer which can effectively carry out pretreatment for coating a printing sheet with an ink receiptor layer and after-treatment for coating the sheet after printing with a transparent protector layer, and has a rational structure to make the overall size of the printer small and light.

SUMMARY OF THE INVENTION

To attain the objects described above according to this invention, there is provided a thermal transfer color printer comprising a sheet feed portion having a sheet stacker for containing one or more printing sheets, a printing portion for thermally printing the printing sheet with thermal transfer color inks applied onto an ink ribbon by driving a thermal head, a sheet discharge portion having a sheet discharge tray for receiving the sheet fed from the printing portion after printing, which sheet feed portion, printing portion and sheet discharge portion are arranged in the shape of Y.

On a joint or branch portion at which the sheet feed portion, printing portion and sheet discharge portion are connected in the shape of Y, a directional control gate is mounted for alternatively forming a passage connecting the sheet feed portion and the printing portion or a passage connecting the printing portion and sheet discharge portion. The printing sheet which is fed from the sheet feed portion to the printing portion through the directional control gate is subjected there to thermal printing processes for being thermally printed with the color inks of the ink ribbon to reproduce a colored visual impression represented on a computer display or the like. The sheet thus printed is fed out from the printing portion to the sheet discharge portion through the directional control gate.

Since the sheet feed portion, printing portion and sheet discharge portion are arranged in the shape of a Y, the sheet feed portion and the sheet discharge portion are in close vicinity to each other and the passages from the sheet feed portion to the printing portion and from the printing portion to the sheet discharge portion can be commonly used in part. Therefore, the overall size of the printer can be made compact, and the passage for feeding the printing sheet in the printer can be practically shortened.

On the printing portion, there may be provided means for coating the printing sheet prior to printing with an ink receiptor layer to make the surface of the printing sheet smooth and improve fixing of the inks on the printing sheet. Furthermore, on the sheet discharge portion, there may be provided means for coating the sheet after printing with an ink protector layer to intimately fix the color inks on the sheet and prevent discoloration of the inks printed on the sheet.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The present invention will become more fully understood from the detailed description given hereinbelow and the accompanying drawings which are given by way of illustration only, and thus are not limitative of the present invention, wherein.

DESCRIPTION OF THE PREFERRED EMBODIMENTS

Figure 1:
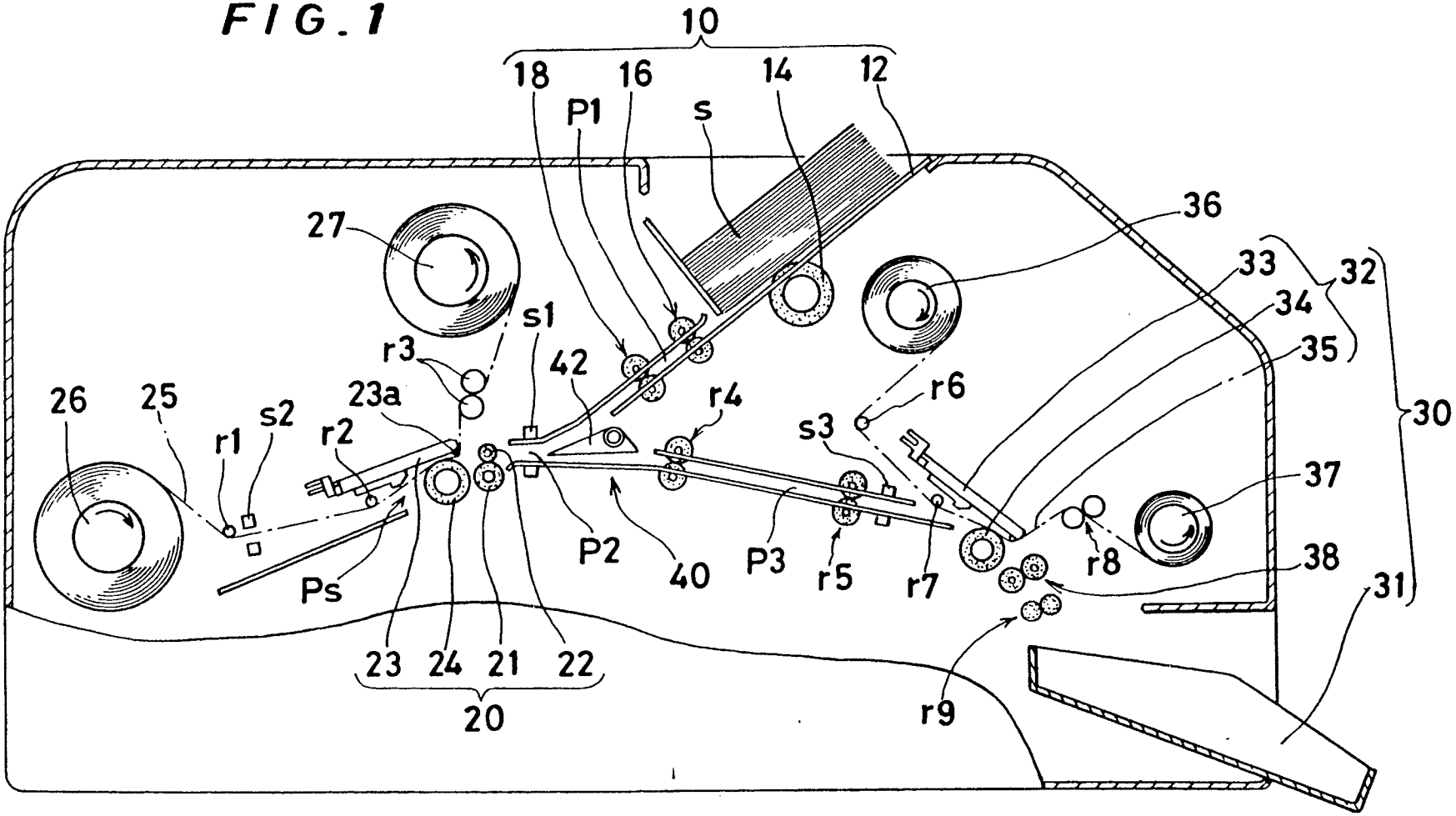
FIG. 1 is a sectional side view schematically showing one embodiment of a thermal transfer color printer according to this invention.
Figure 2:
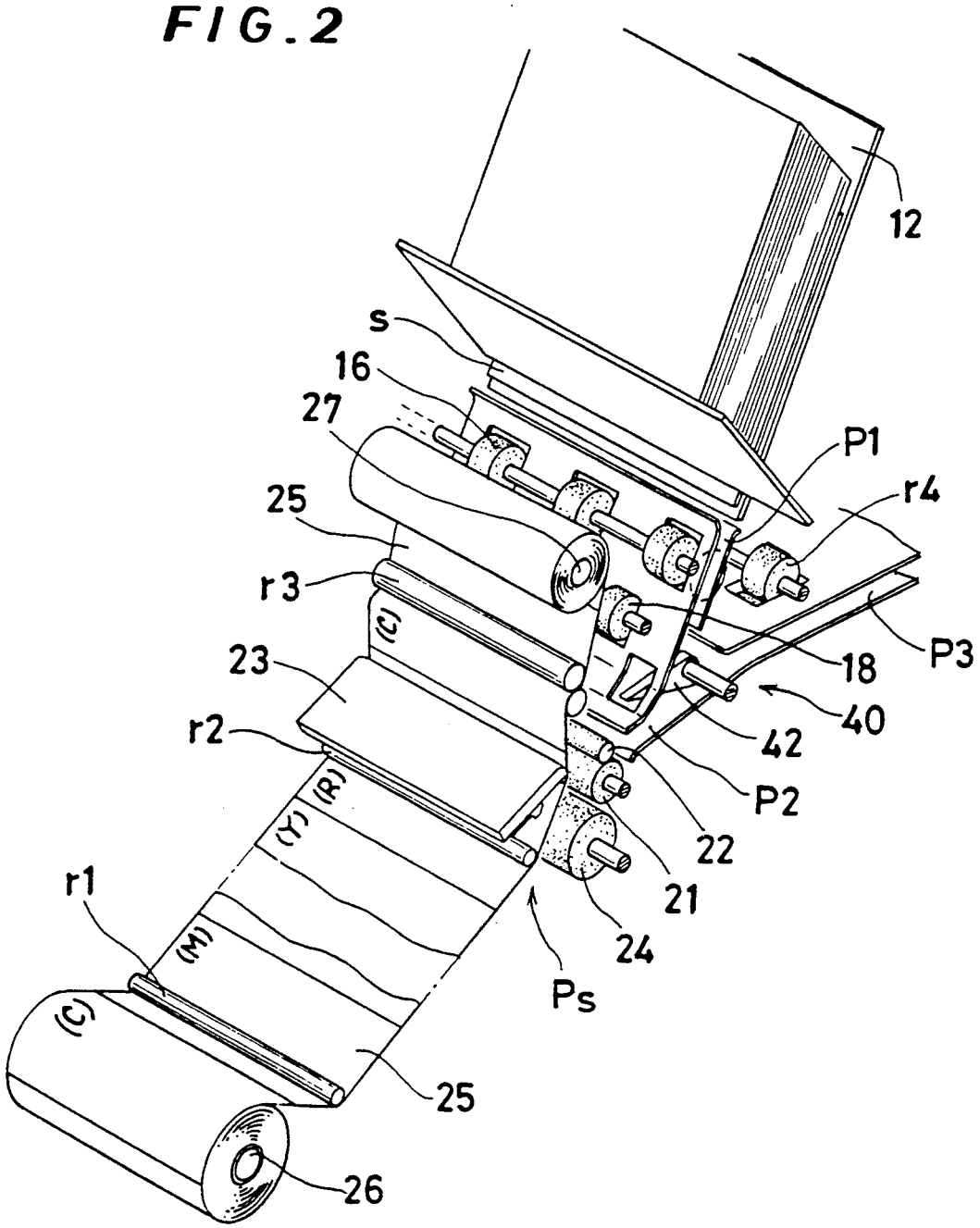
FIG. 2 is a perspective view showing the principal portion of the color printer of FIG. 1.

In FIG. 1 is presented a schematic illustration of an excellent color printer of the present invention having a rational arrangement of a passage for feeding a printing sheet such as paper. The illustrated color printer comprises a sheet feed portion 10, a printing portion 20, a sheet discharge portion 30, which are arranged around a branch portion 40 in the shape of a Y. That is, these portions 10, 20 and 30 have first, second and third sheet passages P1, P2 and P3 extending radially from the branch portion 40. In this embodiment, the sheet feed portion 10 is located close to and above the sheet discharge portion 30, and the printing portion 20 is disposed substantially on a level with the branch portion 40.

The sheet feed portion 10 has a sheet stacker 12 on which one or more printing sheets (s) are stacked. The printing sheets can be drawn out from the sheet stacker 12 one by one by rotating kick rollers 14 mounted on the bottom of the sheet stacker 12. On the first sheet passage P1 extending from the sheet stacker 12 to the branch portion 40, there are disposed sheet feeding roller pairs 16 for feeding the printing sheet, and register roller pairs 18 for correcting the inclination of the printing sheet advancing through the passage P1.

Upon giving a printing command to the printer, the kick rollers 14 are first driven to rotate so as to cause the lowermost sheet of the stacked sheets on the sheet stacker 12 to be drawn out from the sheet stacker 12 into the sheet passage P1 and fed to the printing portion 20 by the rotating sheet feeding roller pairs 16 and register roller pairs 18.

Figure 3:
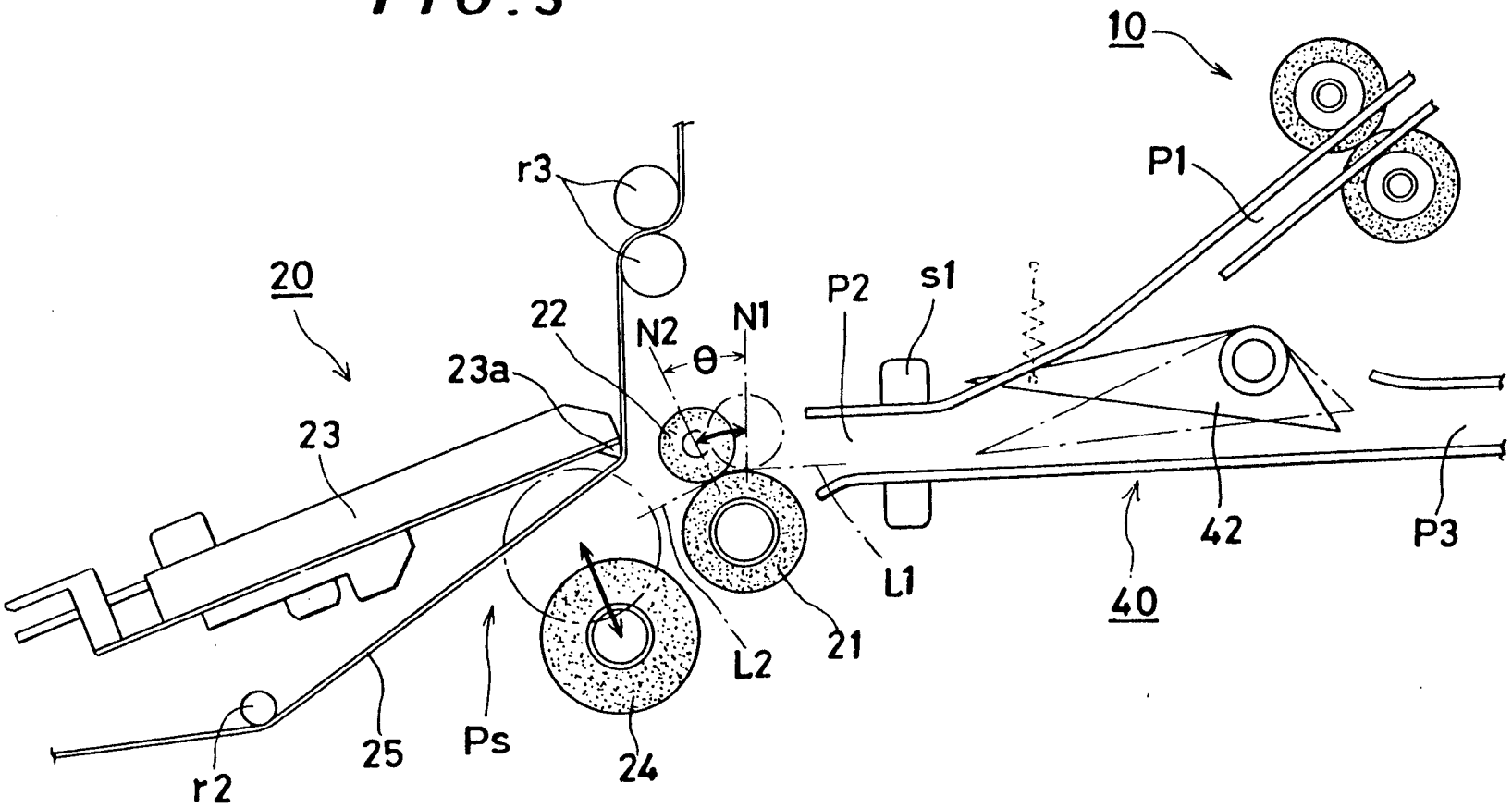
FIG. 3 is a schematic side view of FIG. 2.

The second sheet passage P2 serves as an entrance and exit of the printing portion 20 as clearly illustrated in FIG. 3. Following the sheet passage P2, there are disposed a capstan roller 21 and a pinch roller 22 being in press contact with the capstan roller 21. The capstan roller 21 has a circumferential surface being large in frictional coefficient so as to effectively feed the printing sheet in both directions in conjunction with the pinch roller 22. As indicated by the arrow in FIG. 3, the pinch roller 22 is rotatably rocked about the capstan roller 21 within a prescribed angular range $\theta$ which will be described later in detail. Next to the pinch roller 22, there is mounted a thermal transfer driver unit 23 provided at its leading end portion with a thermal head 23*a*. Adjacent to the capstan roller 21, a platen roller 24 is disposed movably toward or apart from the thermal transfer driver unit 23.

The platen roller 24 is rotated in the same direction and, preferably, at the same circumferential speed as the capstan roller 21. However, the platen roller 24 may be rotated at a different circumferential speed from that of the capstan roller 21 in accordance with the thickness, rigidity or other possible factors of the printing sheet so as to give moderate tension to the printing sheet.

Through a printing space Ps between the thermal transfer driver unit 23 and the platen roller 24, there is supplied a thermal transfer ink ribbon 25 coated with thermal transfer inks such as hot-melt color inks or sublimation-type color inks. Though the color inks in this embodiment are composed of three kinds of yellow (Y), magenta (M) and cyan (C) (three primary colors), the number and kind of colors are by no means limitative. Further, in this embodiment, the thermal transfer ink ribbon 25 is provided with an ink receiptor layer (R) such as a binding or coating material for surface treatment to be previously applied onto the printing sheet prior to printing, so as to make the surface of the printing sheet smooth and improve fixing of the inks on the printing sheet. Thus, the three primary color inks (Y, M, C) following the ink receiptor layer (R) are applied as one unit to the ink ribbon 25 repeatedly. The ink ribbon 25 is originally wound on a supply reel 26, and unwound therefrom to be fed to the printing space Ps. The ink ribbon 25 thus unwound and supplied to the printing sheet at the printing space Ps is finally wound round a take-up reel 27.

Figure 4A:
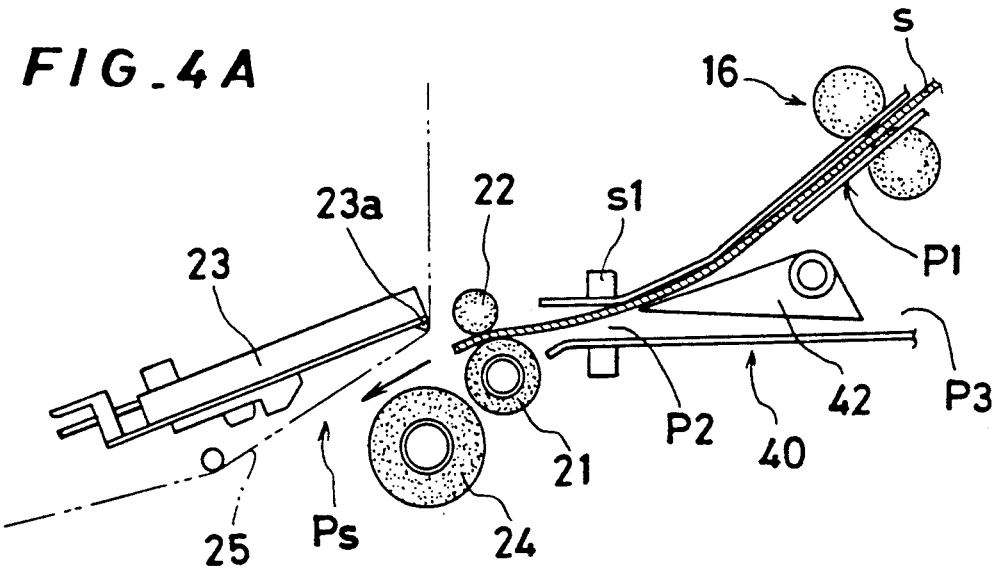
FIGS. 4A through 4C are explanatory views showing the printing process of this invention.
Figure 4B:
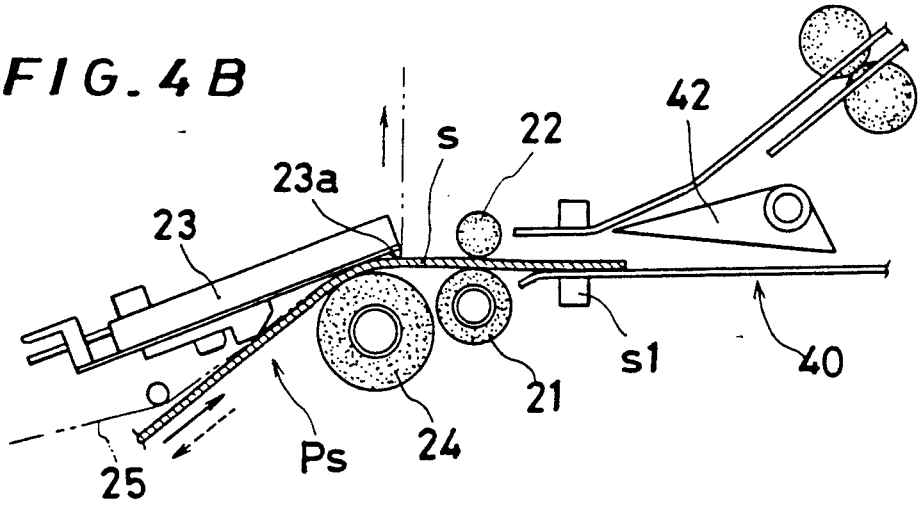
Figure 4C:
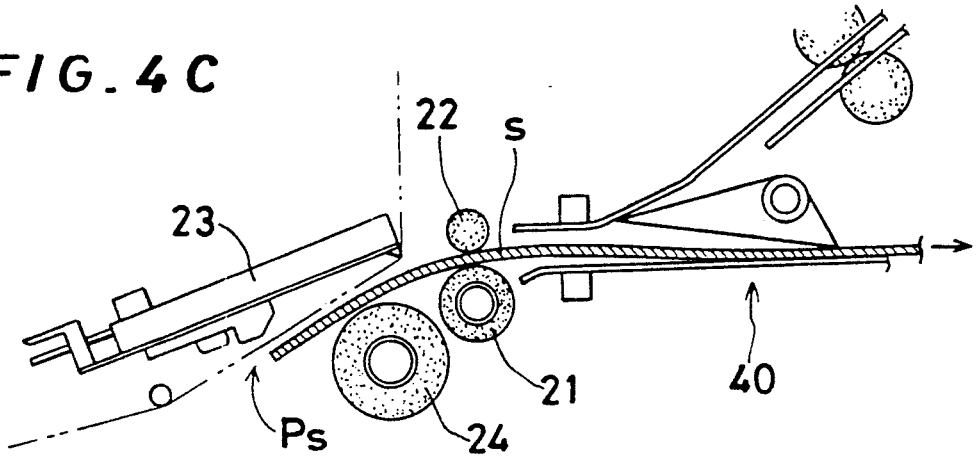

The angular range $\theta$ within which the pinch roller is rotatably rocked is defined between the normal line N1 perpendicular to the tangent line L1 extending from the second sheet passage P2 to the circumference of the capstan roller 21 and the normal line N2 perpendicular to the direction to the printing space Ps. Thus, the pinch roller 22 is positioned on the normal line N2 when the printing sheet (s) fed from the sheet feed portion 10 is introduced into the printing space Ps by driving the capstan roller 21 and pinch roller 22 and moves backward and forward along the printing space Ps in the printing process, as shown in FIG. 4A. When the sheet after printing is discharged from the printing space Ps to the third sheet passage P3, the pinch roller 22 is shifted to the normal line N1 as shown in FIG. 4C.

In the drawings, reference symbol s1 denotes a sheet sensor disposed at the entrance of the second sheet passage P2 for detecting the leading and rear ends of the sheet passing through the passage P2. Denoted by s2 is an ink ribbon sensor for detecting the regions of ink colors (Y, M, C) and ink receiptor layer (R) and to feed each ink color to the prescribed position in the printing space Ps. Symbols r1 and r2 denote guide rollers for the ink ribbon 25, and r3 denotes a pair of ribbon feeding rollers.

The sheet discharge portion 30 has a sheet discharge tray 31 and connected to the second sheet passage P2 of the printing portion 20 via the third sheet passage P3. Thus, the sheet sent out from the printing portion 20 after printing is discharged to the sheet discharge tray 31 through the third sheet passage P3.

In this embodiment, the sheet discharge portion 30 has a protector coating means 32 for coating the sheet after printing with a transparent protector layer so as to intimately fix the color inks onto the sheet and prevent discoloration of the inks printed on the sheet. The protector coating means 32 can however be omitted as occasion arises.

The protector coating means 32 is disposed confronting the exit of the third sheet passage P3 and comprises a thermal transfer driver unit 33 provided at its leading end with a thermal head, a platen roller 34 movable toward the thermal transfer driver unit 33, and a protector ribbon 35 applied with an ink protector layer. The protector ribbon 35 is fed from a winding reel 36 to a take-up reel 37 through between the thermal transfer drive unit 33 and the platen roller 34.

In the drawings, reference symbols r4 and r5 denote feeding rollers disposed on the third passage P3, r6 and r7 denote guide rollers for the protector ribbon 35, and r8 denotes a pair of feeding rollers for the protector ribbon.

Following the thermal transfer driver unit 33, there are disposed sheet feeding roller pairs 38. The protector coating means 32 including the thermal transfer driver unit 33 and platen roller 34 and sheet feeding roller pairs 38 may be constructed similarly to the printing portion 20 including the thermal transfer driver unit 23, capstan roller 21, pinch roller 22 and platen roller 24.

Reference symbol r9 denotes feeding roller pairs, and symbol s3 denotes a sheet sensor disposed on the sheet passage P3 for detecting the leading end of the sheet being fed through the passage P3. When a prescribed time lapses after the sensor s3 detects the leading end of the sheet being fed through the passage P3, the protector coating means 32 is operated.

The branch portion 40 has a directional control gate 42 which is energized by a spring to close the first sheet passage P1 and form a path from the second passage P2 to the third passage P3 under normal conditions as shown by the solid line in FIG. 3. When the sheet is fed along the passage P1, the gate 42 is resiliently urged to open the passage P1 to permit the sheet to pass therethrough as shown by the chain line in FIG. 3.

The manner of operation of the thermal transfer color printer according to this invention to, for example, produce a color hard copy with an image corresponding to a colored visual impression produced on a computer display will be explained hereinafter.

When a printing command is issued from the computer, the kick roller 14 mounted on the bottom of the sheet stacker 12 is driven to draw out the lowermost sheet of the stacked sheets on the sheet stacker to the sheet passage Pl. The sheet (s) drawn out from the sheet stacker is forwarded along the passage P1 by the sheet feeding roller pairs 16. If the sheet (s) advancing through the passage P1 has a tilt relative to the forwarding direction, it is corrected by the register roller pairs 18.

The sheet advancing through the passage P1 passes through the branch portion 40, and then, is introduced into the passage P2. When the sheet passes through the branch portion 40, the directional control gate 42 in the branch portion 40 is resiliently forced out of the passage P1 by the sheet, thereby to permit the sheet to pass therethrough. When the sheet enters into the passage P2, the sheet sensor s1 disposed on the entrance of the passage P2 detects the leading end of the sheet to count the sheet.

The sheet further advancing through the passage P2 is introduced into the printing space Ps formed between the thermal transfer driven unit 23 and the platen roller 24 by the rotating capstan roller 21 and pinch roller 22. At this time, the platen roller 24 is separated from the thermal transfer driven unit 23. When the rear end of the sheet passes through the sheet sensor s1, the sheet sensor s1 starts taking count so that the the rotating capstan roller 21 and pinch roller 22 are stopped at the time that a prescribed time lapses after the sensor s1 detects the rear end of the sheet being fed through the passage P2.

Since the capstan roller 21 and pinch roller 22 are stopped after the prescribed time of passing as noted above, the relative position of the printing sheet to the thermal head 23*a* can be usually insured with a high accuracy. Thus, the transfer of the color inks from the printing ink ribbon on the printing sheet can be always started from the same position on the sheet, thereby to ensure the color inks printed on the sheet in register.

The printing sheet (s) introduced into the printing space Ps is pinched between the thermal transfer driven unit 23 and the platen roller 24 and comes into contact with the thermal head 23*a*. And then, the sheet is moved backward by reversing the capstan roller 21 while driving the thermal head 23*a* to heat. At this time, the ink ribbon 25 moves in the same direction in which the sheet moves at the same speed. Namely, the relative speed of the ink ribbon 25 and the sheet is zero, and when the sheet moves backward in printing, the ink ribbon 25 moves at the same speed while being wound up by the take-up reel 27. Thus, the ink receiptor layer and color inks are exactly transferred onto the sheet.

At the outset of printing, the printing sheet introduced into the printing space Ps confronts the ink receiptor layer (R) on the ink ribbon 25. After coating the sheet with the ink receiptor layer (R) in the first process, the sheet coated with the ink receiptor layer is again introduced into the printing space Ps in preparation for the successive processes of printing the color inks (Y, M, C) on the sheet. Upon completion of transferring the ink receiptor layer and the color inks onto the sheet, the sheet is sent out to the third passage P3 through the second passage P2 by driving the capstan roller 21 and pinch roller 22 as shown in FIG. 4C. The printed sheet thus obtained is forwarded toward the sheet discharge tray 31 by means of the feeding rollers r4 and r5. When the leading end of the sheet passes through the sheet sensor s3, the sheet sensor s3 starts taking count so that the the protector coating means 32 is operated at the time that a prescribed time lapses after the sensor s3 detects the leading end of the sheet being fed through the sheet passage P3. To be more specific, immediately after the printed sheet reaches between the platen roller 34 and thermal transfer driver unit 33, the protector coating means 32 is driven to permit the transparent protector layer applied on the protector ribbon 35 to be thermally transferred to the surface of the printed sheet. In the process of coating the protector layer, the take-up reel 37 is rotated to wind the protector ribbon 35.

The printing process is finished upon sending out the sheet printed and coated with the protector layer to the sheet discharge tray 31 by the rotating feeding rollers 38 and rollers r9.

In a case of subjecting a plurality of printing sheets to the printing process mentioned above, at the time that the preceding sheet is fed from the printing space Ps to around the third sheet passage P3 after printing, the next sheet may be drawn out from the sheet stacker 12 to the first sheet passage P1, whereby the printing process can be continuously carried out and sped up.

Though, in the embodiment described above, the sheet discharge portion 30 is located below the sheet feed portion 10 for convenience of illustration, this structure should not be understood as limitative. It is a matter of course that the sheet feed portion 10 and sheet discharge portion 30 may be arranged horizontally adjoining each other so as to position the printing portion 20 below them and vice versa.

Figure 5:
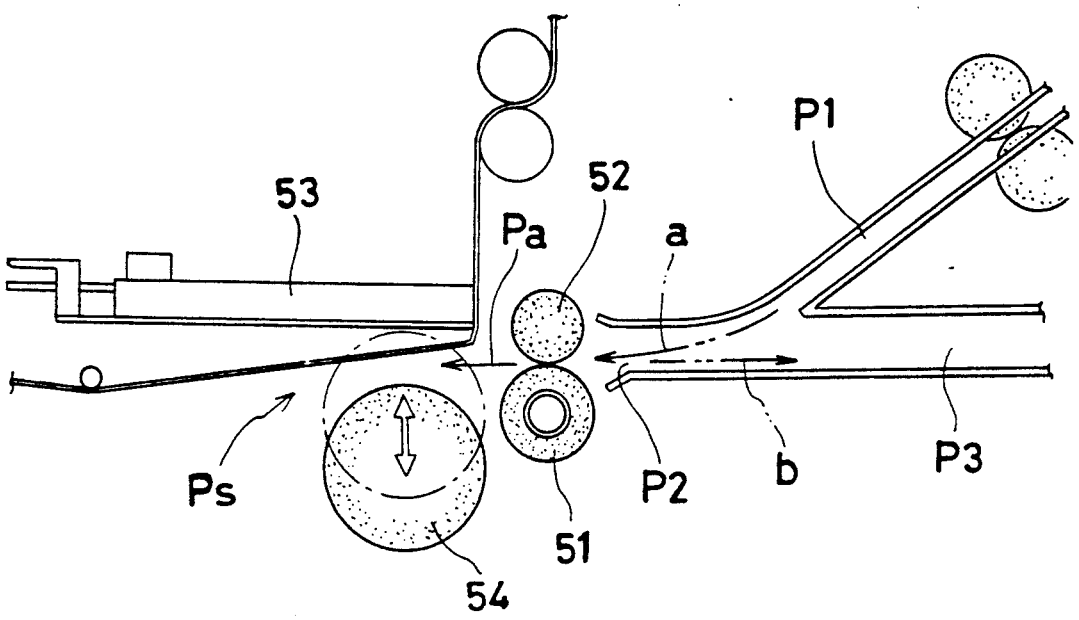
FIG. 5 is a schematic side view of another embodiment of this invention.

FIG. 5 illustrates another embodiment in which a printing space Ps formed between a thermal transfer driver unit 53 and a platen roller 54 is horizontally arranged so that a printing sheet can be introduced straight from a second passage P2 into the printing space Ps. According to this embodiment, there is no need for a mechanism for angularly moving a pinch roller 52 around a capstan roller 51 as explained beforehand with reference to FIG. 3, and furthermore, the directional control gate 42 employed in the foregoing embodiment is not absolutely necessary.

When introducing the printing sheet from the passage P2 into the printing portion Ps as indicated by the arrow "a" in FIG. 5, the platen roller 54 is separated from the thermal transfer drive unit 53. After printing, the sheet is sent out to the passage P3 in the direction indicated by the arrow "b". The elements depicted in the drawing have analogous structures and functions to those of the first embodiment and will not be described in detail again.

Figure 6:
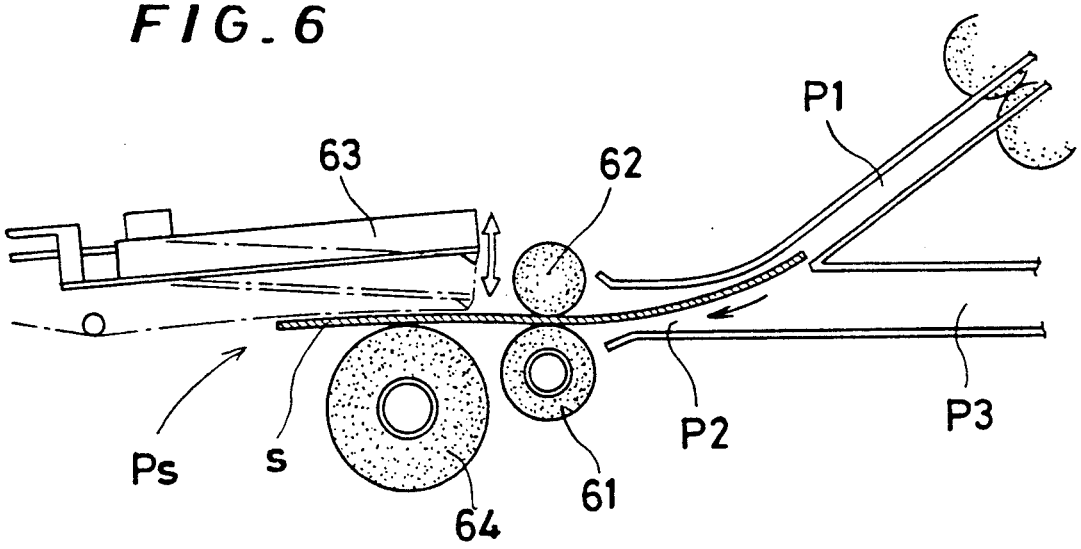
FIG. 6 is a schematic side view of still another embodiment of this invention.

Also in a third embodiment shown in FIG. 6, the passage P3 and the printing space Ps are horizontally aligned. However, a platen roller 64 is rotatably fixed and a thermal transfer driver unit 63 is movable toward the fixed platen roller 64. A printing sheet (s) is introduced from the passage P1 to the printing space Ps through between a capstan roller 61 and a pinch roller 62 as illustrated. The sheet after printing comes out straight to the passage P3 due to its rigidity.

Similarly to the second embodiment described above, the mechanism for angularly moving the pinch roller around the capstan roller and the directional control gate 42 used in the first embodiment are unnecessary for this embodiment.

As is clear from the foregoing description, according to the present invention, the passages for a printing sheet can be shortened by rationally arranging the sheet feed portion, printing portion and sheet discharge portion in the shape of Y. As a result, the overall size of the printer can be reduced, and multicolored prints of good quality can be obtained without misregistration of coloring. Besides, pretreatment for coating the printing sheet with the ink receiptor layer and after-treatment for coating the sheet after printing with the transparent protector layer can be readily carried out.

It is to be understood that the invention is not limited in its application to the details of construction and arrangement of parts illustrated in the accompanying drawings, since the invention is capable of other embodiments and of being practiced or carried out in various ways. Also it is to be understood that the phraselogy or terminology employed herein is for the purpose of description and not of limitation.

What is claimed is:

1. A thermal transfer color printer for printing a color image by use of thermal transfer color inks applied onto an ink ribbon, which comprises:

a substantially Y-shaped branch portion;

a sheet feed portion having a sheet stacker for containing one or more printing sheets and a first sheet passage through which said sheets are sent out from said sheet stacker one by one, said first sheet passage being connected to said branch portion;

a printing portion having a second sheet passage connected to said branch portion, a printing space into which the sheet fed from said sheet feed portion is introduced through said branch portion and said second sheet passage, a thermal transfer driver unit provided with a thermal head for thermally printing said sheet with the color inks, and a platen roller confronting said thermal transfer driver unit; and a sheet discharge portion having a third sheet passage connected to said branch portion and disposed under said first sheet passage, such that said first and third sheet passages are connected to one side of the branch portion and the second sheet passage is connected to the other side of the branch portion, and a sheet discharge tray for receiving said sheet fed from said printing portion after printing;

said platen roller and thermal transfer driver unit being movable relative to each other.

2. The printer according to claim 1, wherein said branch portion has a directional control gate which is energized by a spring so as to close said first sheet passage and form a path from said second sheet passage to said third passage under normal conditions and open said first sheet passage when forwarding said sheet from said sheet feed portion to said second sheet passage.

3. The printer according to claim 1, wherein said printing portion is provided with a capstan roller having a circumferential surface with a large frictional coefficient and a pinch roller being in press contact with said capstan roller for feeding said sheet in both directions in conjunction with said capstan roller.

4. The printer according to claim 3, wherein said platen roller is rotated in a direction same as said capstan roller and at a circumferential speed same as said capstan roller.

5. The printer according to claim 1, wherein said sheet discharge portion is positioned below said sheet feed portion.

6. The printer according to claim 1, wherein said ink ribbon is unwound from a supply reel to be fed to said printing space and wound round a take-up reel.

7. The printer according to claim 1, wherein said color inks are of at least three kinds of colors.

8. The printer according to claim 7, wherein said thermal transfer ink ribbon is provided with an ink receiptor layer for surface treatment.

9. The printer according to claim 1, wherein said sheet discharge portion is provided with means for coating the sheet after printing with a protector layer.

10. The printer according to claim 9, wherein said protector coating means comprises a thermal transfer driver unit provided with a thermal head, and a platen roller movable toward said thermal transfer driver unit of said protector coating means, and wherein a protector ribbon applied with said protector layer is fed from a winding reel to a take-up reel through between said thermal transfer drive unit of said protector coating means and the platen roller of said protector coating means.

11. The printer according to claim 3, wherein said pinch roller is rotatably rocked about said capstan roller within a prescribed angular range.

12. The printer according to claim 1, wherein said thermal transfer driver unit is fixed and said platen roller is movable toward said thermal transfer driver unit.

13. The printer according to claim 1, wherein said platen roller is rotatably fixed and said thermal transfer driver unit is movable toward said platen roller.

14. The printer according to claim 1, wherein said sheet feed portion and sheet discharge portion are constructed so that, when one preceding sheet is fed to said sheet discharge portion after printing, another sheet is drawn out from said sheet feed portion.

15. A thermal transfer color printer for printing a color image by use of thermal transfer color inks applied onto an ink ribbon, which comprises:

a substantially Y-shaped branch portion;

a sheet feed portion having a sheet stacker for containing one or more printing sheets, a kick roller disposed below said sheet stacker for drawing out said sheets from said sheet stacker one by one, and a first sheet passage through which said sheet is sent out from said sheet stacker, said first sheet passage being connected to said branch portion;

a printing portion having a second sheet passage connected to said branch portion, a capstan roller, a pinch roller being in press contact with said capstan roller so as to feed said sheet in both directions in conjunction with said capstan roller, a thermal transfer driver unit provided with a thermal head for thermally printing said sheet with the color inks, and a platen roller confronting said thermal transfer driver unit and defining, between the platen roller and said thermal transfer driver unit, a printing space into which the sheet fed from said sheet feed portion is introduced through said branch portion in and said second sheet passage and through which said ink ribbon is fed; and a sheet discharge portion located close to said sheet feed portion and having a third sheet passage connected to said branch portion and disposed under said first sheet passage, and a sheet discharge tray for receiving said sheet fed from said printing portion after printing;

said platen roller and thermal transfer driver unit being movable relative to each other.

16. The printer according to claim 15, wherein said second sheet passage is provided with a sheet sensor for detecting the sheet being fed through said second sheet passage so as to operate said capstan roller and pinch roller.

17. The printer according to claim 15, wherein said pinch roller is rotatably rocked about said capstan roller within a prescribed angular range.

18. The printer according to claim 15, wherein said sheet discharge portion is positioned below said sheet feed portion.

19. The printer according to claim 15, wherein said branch portion has a directional control gate which is energized by a spring so as to close said first sheet passage and form a path from said second sheet passage to said third passage under normal conditions and open said first sheet passage when forwarding said sheet from said sheet feed portion to said second sheet passage.

20. A thermal transfer color printer for printing a color image by use of thermal transfer color inks applied onto an ink ribbon, which comprises:

a substantially Y-shaped branch portion;

a sheet feed portion having a sheet stacker for containing one or more printing sheets, a kick roller disposed below said sheet stacker for drawing out said sheets from said sheet stacker one by one, and a first sheet passage through which said sheet is sent out from said sheet stacker, said first sheet passage being connected to said branch portion;

a printing portion having a second sheet passage connected to said branch portion, a capstan roller having a circumferential surface with a large frictional coefficient, a pinch roller being in press contact with said capstan roller so as to feed said sheet in both directions in conjunction with said capstan roller, a thermal transfer driver unit provided with a thermal head for thermally printing said sheet with the color inks, a platen roller confronting said thermal transfer driver unit and defining, between the platen roller and said thermal transfer driver unit, a printing space into which the sheet fed from said sheet feed portion is introduced through said branch portion and said second sheet passage and through which said ink ribbon is fed; and a sheet discharge portion located close to said sheet feed portion and having a third sheet passage connected to said branch portion and disposed under said first sheet passage, a sheet discharge tray for receiving said sheet fed from said printing portion after printing, protector coating means for coating the sheet after printing with a protector layer, and a sheet sensor disposed on said third sheet passage for detecting the sheet being fed through said third sheet passage so as to operate said protector coating means;

said platen roller and thermal transfer driver unit being movable relative to each other.

21. The printer according to claim 20, wherein said sheet feed portion and sheet discharge portion are constructed so that, when one preceding sheet is fed to said sheet discharge portion after printing, another sheet is drawn out from said sheet feed portion.

* * * * *